US005831939A

United States Patent [19]

Kaelin

[11] Patent Number: 5,831,939

[45] **Date of Patent: *Nov. 3, 1998**

[54] TIMEPIECE HAVING MEANS FOR POSITIONING A MOVEMENT IN A CASE, AND CASE FOR SUCH A TIMEPIECE

[75] Inventor: Laurent Kaelin, Sonvilier, Switzerland

[73] Assignee: Eta Sa Fabriques D'Ebauches, Grenchen, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 735,635

[22] Filed: Oct. 23, 1996

[30] Foreign Application Priority Data

Oct. 27, 1995 [CH] Switzerland ..... 03034/95

[51] Int. Cl.[6] ..... G04B 37/00; G04B 29/00

[52] U.S. Cl. ..... 368/276; 368/300; 368/309

[58] Field of Search ..... 368/88, 276, 285, 368/291, 294, 296, 299, 300, 309

[56] References Cited

U.S. PATENT DOCUMENTS

| | | | |
|---|---|---|---|
| 4,421,423 | 12/1983 | Lederrey | 368/291 |
| 4,529,323 | 7/1985 | Gagnebin | 368/291 |
| 4,995,023 | 2/1991 | Muller | 368/276 |

FOREIGN PATENT DOCUMENTS

| | | |
|---|---|---|
| 64950 | 11/1982 | European Pat. Off. . |
| 306037 | 3/1989 | European Pat. Off. . |
| 837075 | 3/1952 | Germany . |
| 2218623 | 11/1973 | Germany . |
| 43503 | 5/1908 | Switzerland . |
| 645770 | 10/1980 | Switzerland . |

*Primary Examiner*—Vit W. Miska
*Attorney, Agent, or Firm*—Sughrue, Mion, Zinn, Macpeak & Seas, PLLC

[57] ABSTRACT

A timepiece and a case intended to fit such a timepiece. This timepiece comprises a clockwork movement (12), a case (2) consisting of a caseband (4) and a back cover (6) forming a housing (10) for receiving said movement (12), means for axial positioning (25, 26) and means for lateral positioning (P) of the movement (12) with respect to the case (2). The axial positioning means are arranged in a peripheral region of the housing (10) and may allow a lateral play along a support plane (27). The lateral positioning means (P) are arranged respectively on the back cover (6) of the case (2) and on a lower part (14*b*) of the frame (14), preferably in the form of a central stud (6) fixed to the back cover (6) and engaged with an axial play in an opening (38) of the movement.

20 Claims, 2 Drawing Sheets

TIMEPIECE HAVING MEANS FOR POSITIONING A MOVEMENT IN A CASE, AND CASE FOR SUCH A TIMEPIECE

BACKGROUND OF THE INVENTION

The present invention concerns a timepiece, in particular a wristwatch, comprising a clockwork movement having an axis and a frame, a case consisting of a caseband and a back cover forming a housing for receiving said movement, means for axial positioning of the movement with respect to the case by means of support surfaces which extend in a plane perpendicular to said axis in a peripheral region of said frame and said housing, and means for lateral positioning of the movement with respect to the case.

This invention also concerns a case intended for use in such a timepiece.

Lateral positioning of a clockwork movement in a case, which is also called radial positioning, is, in conventional constructions, assured by an external rim of the movement which is engaged in a peripheral shoulder arranged inside the case. This rim is often formed by a radial flange which is also used for axial positioning of the movement.

Lateral positioning must be assured with great precision for several reasons. Indeed, it is understood that the time display means, and in particular the hands in the case of an analogue display, must be perfectly centered with respect to the exterior of the watch, i.e. with respect to the crystal-case assembly, and in particular with respect to the rim of the caseband.

These hands are of course mechanically linked to the movement and it is the precision of the fit between the movement and the case which will condition the positioning quality of such hands with respect to said exterior.

Moreover, for timepieces of the chronograph type which comprise push buttons in addition to the time-setting crown, it is important for the movement to be precisely positioned with respect to the case, since these push buttons, which are mounted so as to slide in the caseband, must actuate a mechanical or electromechanical contact fixed to the movement. Given that one wishes to limit the travel of such push buttons, it is understood that the precise positioning of the movement with respect to the case must be able to be assured.

However, it is difficult in conventional constructions to obtain precise lateral positioning, since this precision depends directly upon the precision of the internal diameter of the case, on which the external rim of the movement engages. Given that one is concerned with a large diameter, it is relatively expensive to machine such diameter within very restricted machining tolerances.

The situation is even more difficult in the case of movements which comprise a frame made of a plastic material, and which have to be assembled with precision in a metal case. The difference between the expansion coefficients of the two types of material requires the presence of an assembly play which should, on the contrary, be avoided, as indicated hereinabove. This assembly play has to be significant since it is precisely with regard to large diameters that the expansion phenomena are greatest and it is thus between these large diameters that mechanical stresses consequently appear. It will be mentioned here that timepieces are subjected to test temperatures varying between −20 and +70 degrees Celsius.

Publication EP-A-396 007 discloses a watch of the type defined in the preamble hereinabove. Immediately beneath the dial of the watch, the movement exhibits a radial flange called a fillet, which is gripped axially between the dial and an annular shoulder of the case, extending in a parallel plane to the dial, in order to assure axial positioning. Lateral positioning is assured by means of two centering elements in the form of nails or screws which are driven into the case in an axial direction. Each of these elements has a cylindrical head which emerges from said shoulder and engages in a sliding manner in an opening of the same diameter provided in the flange of the movement.

Although this system of transversal positioning exhibits ease of construction and assembly and is suitable for cases where the case and/or the frame of the movement are moulded parts, it does not avoid the aforementioned problem of differential expansion. Further, it does not allow very precise positioning of the centering elements, nor machining of such elements after they have been fixed to the case.

Patent CH 43503 proposes to fix a watch movement in its case by screwing the movement onto a central threaded stud which is attached to the back cover of the case, the lower part of the frame being fitted with a fixed central nut. Axial and lateral positioning is assured by cooperation of two complementary conical surfaces arranged respectively on an upper flange of the movement and on the rim of the upper opening of the case. The application of this system would necessitate expensive machining of the conical surfaces on the periphery and would also be incompatible with current methods of production by moulding and automated assembly.

Publication EP-A-64 950 discloses a watch case having two elastomeric studs on the back cover of the case, but these studs only abut axially on the movement, from which they are separated by a lateral clearance.

SUMMARY OF THE INVENTION

An object of the present invention is to overcome the aforementioned disadvantages by providing a timepiece having a construction such that the movement may be assembled in the case easily and rapidly in a manner assuring, long term, a high level of lateral precision, without risking subjecting the movement to stresses due to expansion. Another object of this invention is to provide an inexpensive solution, in particular in certain applications, such as the case of injection moulded cases, and to avoid precise machining of centering surfaces having a large diameter.

A further object of the present invention is to provide a case overcoming the above problem and able to be used with such a timepiece.

The invention thus concerns a timepiece of the type indicated in the preamble, characterised in that said lateral positioning means are formed by at least a pair of complementary elements of small size relative to the transversal dimensions of the frame, said complementary elements being arranged respectively on the back cover of the case and on a lower part of the frame, and in that one of said complementary elements is a centering opening and the other is a projecting stud engaged by sliding axially into said opening.

Thus, the effect of the invention is to disassociate completely the axial positioning means and the lateral positioning means, to allow these latter to be made at a location and in a form which allows machining which is both very precise and inexpensive. The movement is positioned axially by resting in a perpendicular plane to the axis, where, if necessary, it can have a lateral play enabling the differential radial expansion between the case and the movement to be absorbed, as well as the manufacturing and assembly tolerances in any direction of said plane, i.e. in the directions of the large dimensions of the case and movement. The flat axial support surfaces, arranged on the periphery, have a large diameter assuring good stability of the movement and they are not expensive to make precisely, in particular by moulding.

For their part, the lateral positioning elements have preferably an axial play, so that they hold the movement in the case solely laterally, to prevent it from sliding in the axial support plane. They may be placed at the centre of the timepiece or close to such centre, so that centering is not affected by differential expansion or dimensional variations due to shrinkage of the moulded parts. As a result of their small diameter, they can be machined with precision at a lower cost than peripheral surfaces.

The stud preferably projects from the back cover towards the housing receiving the movement, while the centering opening in which the stud engages is arranged in said lower part of the frame.

According to the invention, a case for such a timepiece comprises a caseband and a back cover forming a housing for receiving a movement, the case being characterised in that it comprises at least one cylindrical centering stud fixed to said back cover and projecting from said back cover towards the housing, said stud being intended to position the movement laterally with respect to the case. The stud and the back cover are preferably made in a single piece and also of the same material and the stud is situated preferably in the centre of the back cover.

Other characteristics or advantages of the invention will appear upon reading the detailed description which follows, made with reference to the attached drawings which are given solely by way of example and in which:

DESCRIPTION OF PREFERRED EMBODIMENTS

Figure 1:
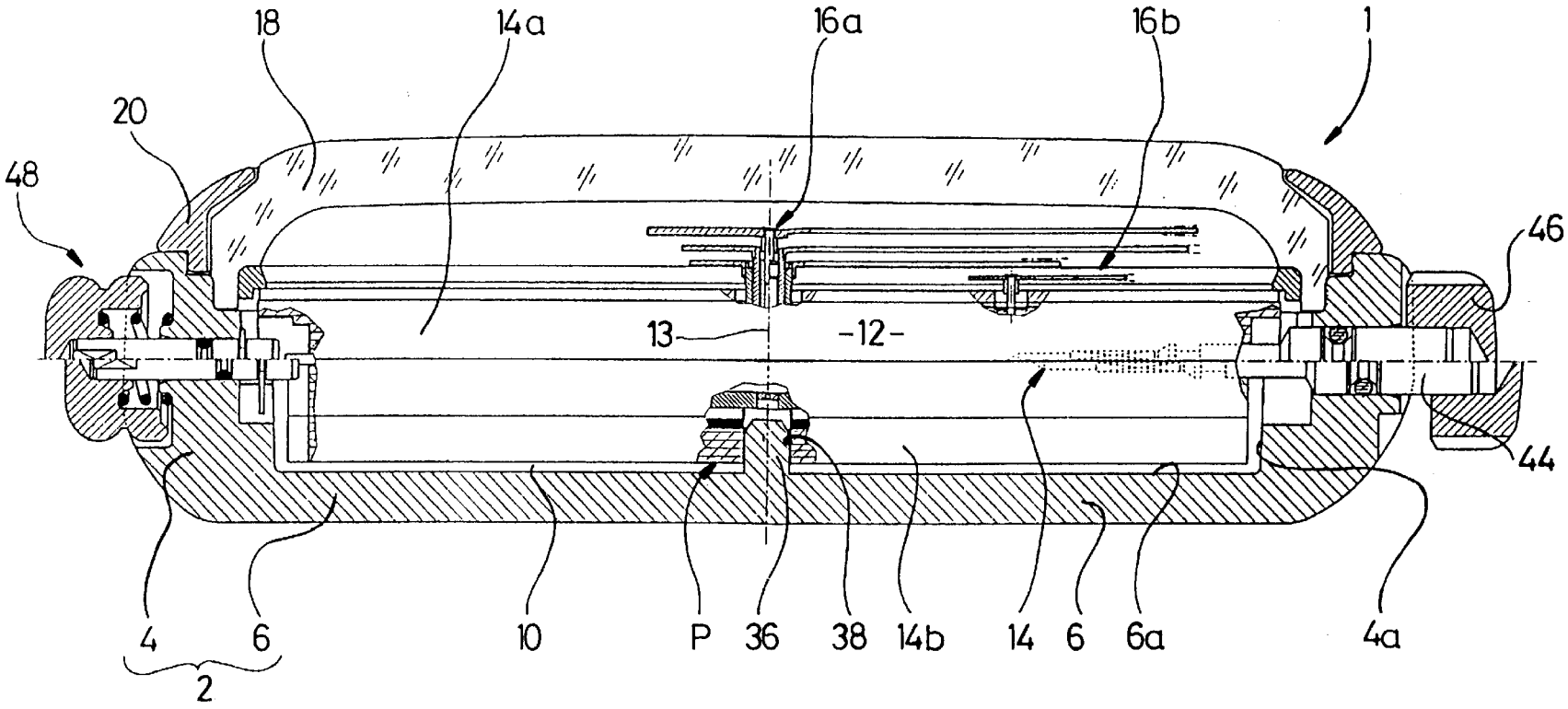
FIG. 1 is a schematic cross-section of a timepiece and a case according to an embodiment of the invention, this cross-section passing via a time-setting stem and via a push button of said timepiece.
Figure 2:
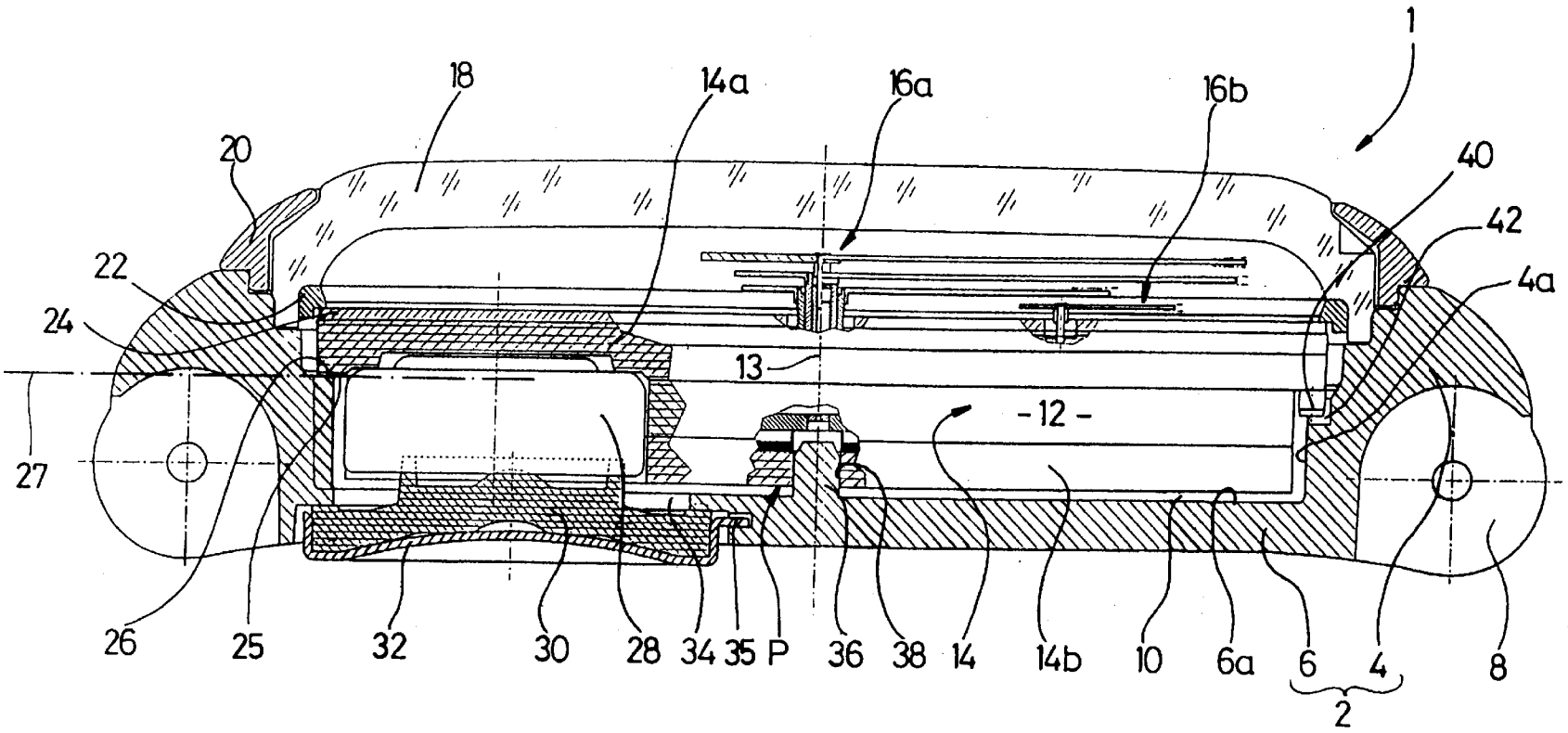
FIG. 2 is a schematic cross-section of the timepiece of FIG. 1, but along a 12 o'clock-6 o'clock axis of said timepiece.

Referring to FIGS. 1 and 2, a timepiece and a case according to the invention will be described hereinafter, said timepiece being designated here by the general reference 1.

Timepiece 1 comprises a case 2, in particular of the type consisting of a single piece, formed of a caseband 4 and a back cover 6. Horns 8, provided to enable the links of a bracelet (not shown here) to be attached, are arranged on case 2 in a conventional manner.

Within case 2 is arranged a housing 10 which is defined within the case by caseband 4 and back cover 6, and more particularly by their respective internal walls, referenced 4*a* and 6*a*.

Timepiece 1 further comprises a clockwork movement 12 which is housed inside housing 10. This movement 12, having a central axis 13, comprises a frame 14 which consists of an upper part 14*a* containing a bridge and a lower part 14*b* containing a plate. Frame 14 supports, in a conventional manner, the mechanical, electrical and/or electromechanical components driving display means 16 of the digital or analogue type, formed in this example by two hand display means 16*a* and 16*b*. Hand display means 16*a* is hand display means disposed at the center comprising the hour, minute and second hands; hand display means 16*b* is off-centre and comprises one hand, for example a chronograph hand.

Timepiece 1 also comprises a crystal 18 and a bezel 20 both snap fitted in caseband 4.

As is shown in FIG. 2, crystal 18 abuts axially a flange 22 which holds movement 12 by abutting in the same direction on dial 24 which rests on upper part 14*a* of the frame. Such upper part 14*a* has a peripheral shoulder forming a flat annular surface 25 which itself rest on a flat surface 26 of a shoulder arranged in internal wall 4*a* of caseband 4. Thus, enlarged upper part 14*a* of the frame plays the part of a conventional flange or fillet, but only for assuring axial positioning. At each axial support point of surfaces 25 and 26, movement 12 can preferably enjoy a lateral play in plane 27 of these surfaces, which is perpendicular to central axis 13. This allows any differential expansion to be absorbed and the manufacturing tolerances in a radial direction in the peripheral region of the case and the movement to be increased.

Movement 12 further comprises a battery 28 which is held in an appropriate housing (not referenced) by a sealing gasket 30 fixed to a cover 32. Sealing gasket 30 and cover 32 close a battery housing 34 arranged in back cover 6. Cover 32 is engaged in back cover 6 via a bayonet system 35.

Timepiece 1 comprises lateral positioning means P assuring lateral (or radial) positioning of movement 12 in and with respect to case 2. Such positioning means P are arranged between back cover 6 and lower part 14*b* of frame 14.

More particularly, in a preferred embodiment, these positioning means P consist, on the one hand, of a cylindrical stud 36 which projects from back cover 6 towards housing 10, and on the other hand, of a centering opening 38 in which stud 36 is engaged. Centering opening 38 is arranged in lower part 14*b* of frame 14, for example along central axis 13 of the movement, and it is formed directly during the injection moulding of frame 14 which is made of a plastic material. This opening 38 is thus obtained via an appropriately positioned mould core in the injection mould (not shown). This configuration thus allows the obtaining of very narrow tolerance ranges and perfect reproducibility of shapes and dimensions to be guaranteed, in comparison with conventional positioning systems which were usually provided on the periphery of upper part 14*a*.

Stud 36 and back cover 6 are made in a single piece and of the same material which in this case is metal. It is to be noted that case 2 is preferably made via a metal injection moulding method, called MIM (Metal Injection Moulding).

Thus, as these positioning means are provided on the back cover of case 2, they offer a particularly advantageous solution, since, after being implemented, this injection moulding method leaves a carrot, which is the cylinder of material which remains in the channel of the mould, just after the injection nozzle has been removed. In order to obtain stud 36 according to the invention, this carrot is then machined, whereas until now it had to be removed in conventional constructions. Advantage is thus taken of this carrot to make stud 36.

However, the same construction may advantageously be applied when case 2 is moulded in a ceramic, plastic or other material, or when it is not moulded. Stud 36 could also be a separate part, added onto back cover 6.

It will be indicated here that the diameter of stud 36 and that of opening 38 are approximately 1.5 mm, while the largest movement diameter is usually comprised within the range of 18 to 30 mm.

The largest transversal dimension (diameter) of stud 36 is typically smaller than one tenth of the largest transversal dimension (diameter) of housing 10.

Stud 36 and centering opening 38 thus have a small diameter compared to those of movement 12 and housing 10. Precise machining of the stud is thus easier than that of the centering surface of the prior art, on the periphery of housing 10. It will be noted that this stud 36 and this opening 38 are in this example centered with respect to timepiece 1, especially with respect to housing 10. This position has several advantages. It facilitates precise positioning of the tool for machining the stud. It also facilitates angular positioning of the movement during casing up, by allowing small pivoting about the centre without the movement drawing near to internal peripheral wall 4*a*. In the case of chronographs, whose push buttons are generally oriented towards the centre, stud 36 and opening 38 are situated just on the line of action of each push button, so that this action does not tend to cause the movement to pivot.

The movement may also be roughly angularly positioned during casing up of frame 14, via an element projecting from frame 14, in this case a pin 40 engaged with a certain lateral play in a recess 42 arranged in internal peripheral wall 4*a* of caseband 4. Finer angular positioning may then be carried out via a time-setting stem 44 mounted so as to slide in caseband 4 and comprising a control crown 46.

By way of example, the timepiece shown in FIG. 1 also comprises a push button 48 likewise sliding in caseband 4 along a line of action on which stud 36 is located (i.e.,along a line which intersects the central axis 13 which is the axis of stud 36) as illustrated in FIG. 1, and able to actuate a mechanical and/or electric element of movement 12, for example a chronograph device.

The invention is not limited to the embodiment illustrated. It could comprise two studs, not centered, engaged in two corresponding centering openings, one of the openings being oblong to absorb the expansion phenomena. In such case, time-setting stem 44 would no longer have the function of angularly positioning frame 14.

According to another embodiment, stud 36 could be arranged on frame 14 so as to extend towards back cover 6 and engage in an opening made in such back cover. This solution is however less optimal, in particular because of the risk of deterioration of the stud during assembly. Moreover, a projecting stud beneath the movement would impede handling of the latter during manufacturing, tests and storage.

What is claimed is:

1. A timepiece of the type comprising:

a clockwork movement having an axis and a frame;

a case consisting of a caseband and a back cover forming a housing for receiving said movement;

means for axial positioning of said movement with respect to said case by means of support surfaces which extend in a plane perpendicular to said axis in a peripheral region of said frame and said housing; and means for lateral positioning of the movement with respect to the case, wherein said lateral positioning means comprises at least a pair of complementary elements of small size relative to transversal dimensions of said frame, said pair of complementary elements comprising an unthreaded stud projecting from said back cover towards said housing, and a centering opening arranged in a lower part of said frame, and wherein said stud is axially slidingly engaged in said opening.

2. A timepiece according to claim 1, wherein said centering opening and said stud have complementary cylindrical surfaces of same diameter.

3. A timepiece according to claim 1, wherein said back cover and said stud are made of metal, while said lower part of the frame is made of a plastic material.

4. A timepiece according to claim 1, wherein said stud and said back cover are made in a single piece and of the same material.

5. A timepiece according to claim 1, wherein said lateral positioning means comprises a single stud and a single centering opening and wherein said stud and said opening are centered with respect to said housing.

6. A timepiece according to claim 5, further comprising angular positioning means comprising a projecting element arranged on the frame and engaged with a lateral play in a recess arranged in an internal peripheral wall of the case.

7. A timepiece according to claim 1, wherein said housing has a diameter and said stud has a diameter smaller than one tenth of the housing diameter.

8. A timepiece according to claim 5, wherein said housing has a diameter and said stud has a diameter smaller than one tenth of the housing diameter.

9. A timepiece according to claim 1, wherein said stud is cylindrical.

10. A timepiece according to claim 1, wherein a push button is slidingly mounted in said caseband and has a line of action, and wherein said stud is situated on said line of action.

11. A timepiece according to claim 1, wherein said stud is situated centrally on said back cover.

12. A timepiece comprising:

a clockwork movement having an axis and a frame;

a case including a caseband and a back cover and forming a housing for receiving said movement;

means for axial positioning of said movement with respect to said case, said axial positioning means extending in a peripheral region of said frame and said housing; and means for lateral positioning of the movement with respect to said case;

wherein said lateral positioning means is separate from said axial positioning means, and comprises a stud, projecting from said back cover towards said housing; and a centering opening arranged in a lower part of said frame, said stud being engaged with axial play in said opening.

13. The timepiece according to claim 12, wherein said centering opening and said stud have complementary cylindrical surfaces of same diameter.

14. The timepiece according to claim 12, wherein said axial positioning means allows lateral play for the clockwork movement.

15. The timepiece according to claim 12, wherein said axial positioning means comprises support surfaces which extend in a plane perpendicular to said axis on said frame and said caseband.

16. The timepiece according to claim 12, wherein said stud is situated centrally on said back cover.

17. The timepiece according to claim 12, wherein said lateral positioning means comprises a single stud and a single centering opening, and wherein said stud and said opening are centered with respect to said housing.

18. The timepiece according to claim 17, further comprising angular positioning means comprising a projecting element arranged on the frame and engaged with lateral play in a recess arranged in an internal peripheral wall of the case.

19. The timepiece according to claim 12, wherein said housing has a diameter and said stud has a diameter smaller than one tenth of the housing diameter.

20. The timepiece according to claim 12, wherein said stud is cylindrical.

* * * * *